US009008332B2

(12) United States Patent
Wang et al.

(10) Patent No.: US 9,008,332 B2
(45) Date of Patent: Apr. 14, 2015

(54) PROCESSING CHIP FOR A DIGITAL MICROPHONE AND RELATED INPUT CIRCUIT AND A DIGITAL MICROPHONE

(75) Inventors: Wenjing Wang, Beijing (CN); Jianting Wang, Beijing (CN); Rongrong Bai, Beijing (CN); Jing Cao, Rancho Santa Margarita, CA (US)

(73) Assignee: Beijing KT Micro, Ltd., Beijing (CN)

( * ) Notice: Subject to any disclaimer, the term of this patent is extended or adjusted under 35 U.S.C. 154(b) by 737 days.

(21) Appl. No.: 13/248,975

(22) Filed: Sep. 29, 2011

(65) Prior Publication Data

US 2012/0250898 A1 Oct. 4, 2012

(30) Foreign Application Priority Data

Oct. 9, 2010 (CN) ..... 2010 1 0505911

(51) Int. Cl.
*H04R 3/00* (2006.01)
*H04R 19/04* (2006.01)
*H04R 3/06* (2006.01)

(52) U.S. Cl.
CPC *H04R 3/00* (2013.01); *H04R 19/04* (2013.01); *H04R 3/06* (2013.01)

(58) Field of Classification Search
USPC ..... 381/111, 113–114, 122, 174, 58, 120, 381/355, 119, 91, 92, 95, 77, 79; 330/252, 330/253, 260, 297, 303, 306
See application file for complete search history.

(56) References Cited

U.S. PATENT DOCUMENTS

| | | | | |
|---|---|---|---|---|
| 5,796,848 | A * | 8/1998 | Martin | 381/320 |
| 6,888,408 | B2 * | 5/2005 | Furst et al. | 330/277 |
| 6,898,096 | B2 * | 5/2005 | Endo et al. | 363/147 |
| 6,963,140 | B2 * | 11/2005 | Sin et al. | 257/784 |
| 7,110,560 | B2 * | 9/2006 | Stenberg | 381/113 |
| 8,582,787 | B2 * | 11/2013 | David et al. | 381/120 |
| 2007/0009111 | A1 * | 1/2007 | Stenberg et al. | 381/113 |
| 2007/0076904 | A1 * | 4/2007 | Deruginsky et al. | 381/95 |

* cited by examiner

*Primary Examiner* — Davetta W Goins
*Assistant Examiner* — Kuassi Ganmavo
(74) *Attorney, Agent, or Firm* — J.C. Patents

(57) ABSTRACT

A processing chip for a digital microphone and related input circuit and a digital microphone are described herein. In one aspect, the input circuit for a processing chip of a digital microphone includes: a PMOS transistor, a resistor, a current source, and a low-pass filter. The described processing chip possesses high anti high-frequency interference capabilities and the described input circuit possesses high high-frequency power supply rejection ratio.

6 Claims, 3 Drawing Sheets

PROCESSING CHIP FOR A DIGITAL MICROPHONE AND RELATED INPUT CIRCUIT AND A DIGITAL MICROPHONE

RELATED APPLICATIONS INFORMATION

The application claims priority under 35 U.S.C. 119(a) to Chinese application number 201010505911.1, filed on Oct. 9, 2010, which is incorporated herein by reference in its entirety as if set forth in full.

BACKGROUND

1. Technical Field

The embodiments described herein relate to electronic circuits, and more particularly, to a processing chip for a digital microphone and related input circuit and a digital microphone.

2. Related Art

Digital microphone is the electro-acoustic component of microphone for directly outputting the digital pulse signal. Digital microphone has the characteristics of high anti-interference capacities, high integration, and ease of use. As a result, it has been widely used for power and size sensitive portable devices.

FIG. 1 is a structure diagram showing a digital microphone under the existing technologies. The digital microphone includes a microphone 11 and a processing chip 12, in which the processing chip 12 may include an input circuit 120, an amplifier circuit 121 and an analog-to-digital conversion circuit 122. In particular, the microphone 11 converts sound signals into analog electronic signals and sends the analog electronic signals to the processing chip 12. Then the input circuit 120 in the processing chip 12 receives the analog electrical signals and the amplifier circuit 121 amplifies the analog signals, and the analog-to-digital conversion circuit 122 converts the amplified analog electronic signals into digital signals and then outputs the digital signals.

Under the existing technologies, the analog electronic signals outputted by the microphone 11 carry high-frequency interference signals, the analog electronic signals outputted to the amplifier circuit 121 by the input circuit 120 carry relatively strong high-frequency interference signals, resulting in poor anti-high-frequency interference capabilities for the processing chip 12. Moreover, the power supply of the input circuit 120 also carries high-frequency interference signals, resulting in low high-frequency power supply rejection ratio for the input circuit 120.

SUMMARY

A processing chip for a digital microphone and related input circuit and a digital microphone are described herein and the described processing chip possesses high anti high-frequency interference capabilities and the described input circuit possesses high high-frequency power supply rejection ratio.

In one aspect, an input circuit for a processing chip of a digital microphone includes:

A PMOS transistor, wherein the gate of the PMOS transistor includes a first branch and a second branch and said first branch being configured to receive the analog electronic signals outputted by the microphone, the source of said PMOS transistor includes a third branch and a fourth branch, and the drain of the PMOS transistor is configured to connect to a ground signal;

A resistor, wherein one end of the resistor is configured to connect to the second branch of the gate of said PMOS transistor and the other end of the resistor is configured to connect to the ground signal;

A current source, wherein the current source is configured to connect to the fourth branch of the source of said PMOS transistor;

A low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

In another aspect, a processing chip for a digital microphone includes an input circuit, an amplifier circuit, and an analog-to-digital conversion circuit, wherein the input circuit includes:

A PMOS transistor, wherein the gate of the PMOS transistor includes a first branch and a second branch and said first branch being configured to receive the analog electronic signals outputted by the microphone, the source of said PMOS transistor may include a third branch and a fourth branch, and the drain of the PMOS transistor is configured to connect to a ground signal;

A resistor, wherein one end of the resistor is configured to connect to the second branch of the gate of said PMOS transistor and the other end of the resistor is configured to connect to the ground signal;

A current source, wherein the current source is configured to connect to the fourth branch of the source of said PMOS transistor;

A low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

In yet another aspect, a digital microphone includes a microphone and a processing chip, wherein the processing chip includes an input circuit, an amplifier circuit and an analog-to-digital conversion circuit, wherein the input circuit includes:

A PMOS transistor, wherein the gate of the PMOS transistor includes a first branch and a second branch and said first branch being configured to receive the analog electronic signals outputted by the microphone, the source of said PMOS transistor may include a third branch and a fourth branch, and the drain of the PMOS transistor is configured to connect to a ground signal;

A resistor, wherein one end of the resistor is configured to connect to the second branch of the gate of said PMOS transistor and the other end of the resistor is configured to connect to the ground signal;

A current source, wherein the current source is configured to connect to the fourth branch of the source of said PMOS transistor;

A low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

After the analog electronic signals outputted by the microphone are put into the first branch of the gate of the PMOS transistor, and biased by the PMOS transistor, the analog electronics signals, which are outputted through the third branch of the source of the PMOS transistor, are filtered by the low-pass filter and then outputted to the amplifier circuit. Because the low-pass filter filters out the high-frequency interference signals in the analog electronic signals, the processing chip's anti high-frequency interference capabilities are improved. Meanwhile, the low-pass filter also filters out the high-frequency interference signals in the power supply of the input circuit, the high-frequency power supply rejection ratio of the input circuit is increased.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
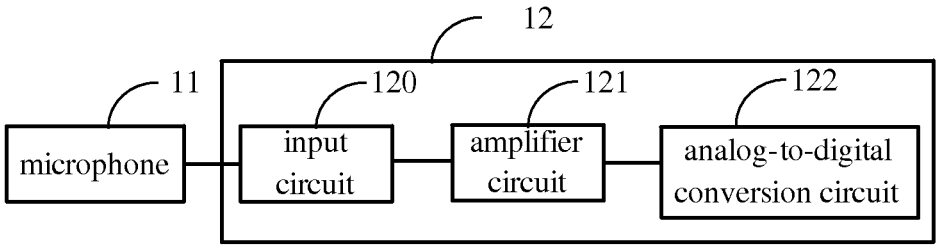
FIG. 1 is a schematic diagram showing a digital microphone under the existing technology.

Referring now to the drawings, a description of embodiments will be made herein.

Figure 2:
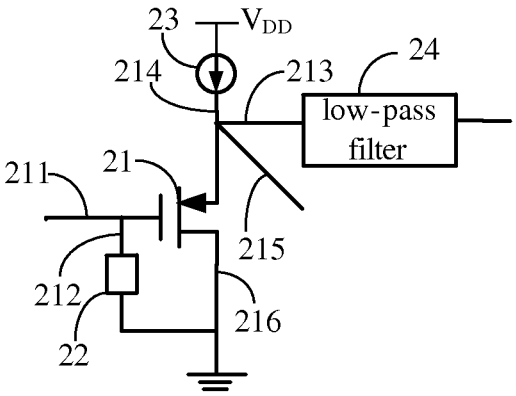
FIG. 2 a schematic diagram showing an input circuit in a processing chip for a digital microphone according to one embodiment.

FIG. 2 a schematic diagram showing an input circuit in a processing chip for a digital microphone according to one embodiment. The input circuit may include a PMOS transistor 21, a resistor 22, a current source 23 and a low-pass filter 24.

In particular, the gate of the PMOS transistor 21 may include a first branch 211 and a second branch 212, the source of the PMOS transistor 21 may include a third branch 213 and a fourth branch 214. The first branch 211 may be configured to receive the analog electronic signals outputted by a microphone, the drain of the PMOS transistor 21 is connected with a ground signal. One end of the resistor 22 may be configured to connect with the second branch 212 and the other end of the resistor 22 may be configured to connect with the ground signal. The current source 23 may be configured to connect with the fourth branch 214. One end of the low-pass filter 24 may be configured to connect with the third branch 213 of the source of the PMOS transistor 21 and the other end of the low-pass filter 24 may be configured to connect with an amplifier circuit.

In this embodiment, after the analog electronic signals outputted by the microphone are put into the first branch 211 of the gate of the PMOS transistor 21, and biased by the PMOS transistor 21, the analog electronics signals, which are outputted through the third branch 211 of the source of the PMOS transistor 21, may be filtered by the low-pass filter 24 and then outputted to the amplifier circuit. Because the low-pass filter 24 filters out the high-frequency interference signals in the analog electronic signals, the processing chip's anti high-frequency interference capabilities are improved. Meanwhile, the low-pass filter 24 also filters out the high-frequency interference signals in the power supply of the input circuit, increasing the input circuit's high frequency power supply rejection ratio.

In addition, in order to reduce the parasitic capacitor between the pad of the first branch and the substrate, the source of the PMOS transistor 21 may further include a fifth branch 215, the fifth branch 215 may be configured to connect with a metal layer underneath the pad of the first branch 211, where the area of the metal layer may be larger than the area of the pad. Specifically, there may be more than one metal layer underneath the pad and the fifth branch 215 may be configured to connect with any of the metal layers.

In addition, in this embodiment, the resistance of the resistor 22 may be greater than or equal to 10 G ohms. In another embodiment, the resistance of the resistor 22 may be greater than or equal to 20 G.

Figure 3:
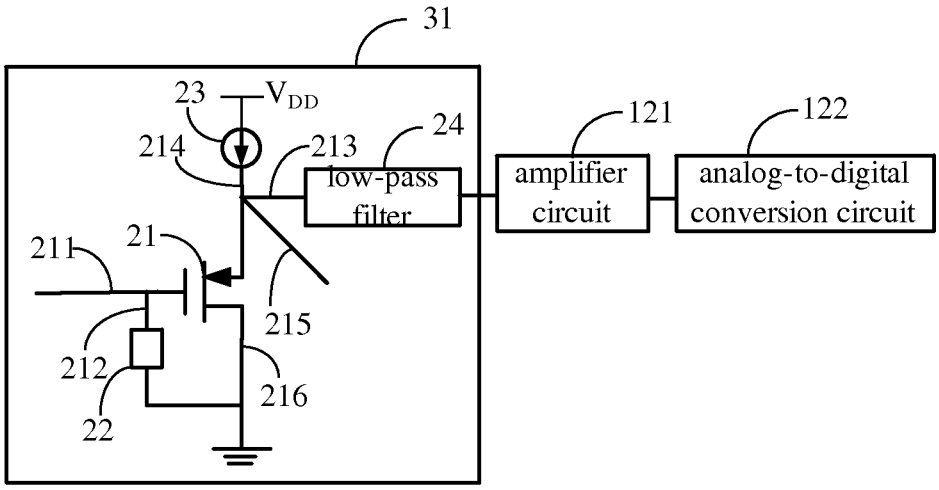
FIG. 3 is a schematic diagram showing a processing chip of a digital microphone according to another embodiment.

FIG. 3 is a schematic diagram showing a processing chip of a digital microphone according to another embodiment. The processing chip may include an input circuit 31, an amplifier circuit 121, and an analog-to-digital conversion circuit 122. The amplifier circuit 121 may be configured to connect with the input circuit 31, and the analog-to-digital conversion circuit 122 may be configured to connect with the amplifier circuit 121. The input circuit 31 may include the aforementioned input circuit in the processing chips for the digital microphone.

In this embodiment, the input circuit 31 may be configured to receive the analog electronic signals outputted by a microphone, the analog electrical signals may be filtered by the low-pass filter 24 in the input circuit 31 and outputted to the amplifier circuit. Because the low-pass filter 24 filters out the high-frequency interference signals in the analog electronic signals, the processing chip's anti-high-frequency interference capabilities are improved. Meanwhile, the low-pass filter 24 also filters out the high-frequency interference signals in the power supply of the input circuit, the high-frequency power supply rejection ratio of the input circuit is increased.

Figure 4:
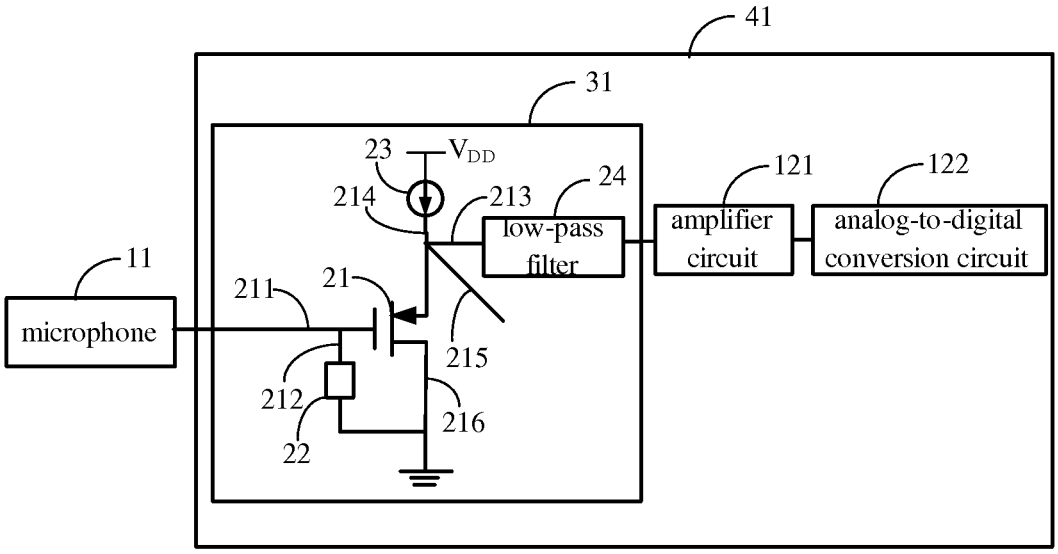
FIG. 4 is a schematic diagram showing a digital microphone according to another embodiment.

FIG. 4 is a schematic diagram showing a digital microphone according to another embodiment. The digital microphone may include a microphone 11 and a processing chip 41. The processing chip 41 may include an input circuit 31, an amplifier circuit 121, and an analog-to-digital conversion circuit 122, the input circuit 31 may be configured to connect with the microphone 11, the amplifier circuit 121 may be configured to connect with the input circuit 31, and the analog-to-digital conversion circuit 122 may be configured to connect with the amplifier circuit 121. In particular, the input circuit 31 may include the aforementioned input circuit in the processing chips for the digital microphone.

In this embodiment, the input circuit 31 may be configured to receive the analog electronic signals outputted by a microphone, the analog electrical signals may be filtered by the low-pass filter 24 in the input circuit 31 and outputted to the amplifier circuit. Because the low-pass filter 24 filters out the high-frequency interference signals in the analog electronic signals, the processing chip's anti-high-frequency interference capabilities are improved. Meanwhile, the low-pass filter 24 also filters out the high-frequency interference signals in the power supply of the input circuit, the high-frequency power supply rejection ratio of the input circuit is increased.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. An input circuit for a processing chip of a digital microphone comprising:

a PMOS transistor, wherein the gate of the PMOS transistor comprises a first branch and a second branch and said first branch being configured to receive the analog electronic signals outputted by the microphone, the source of said PMOS transistor comprises a third branch and a fourth branch, and the drain of the PMOS transistor is configured to connect to a ground signal;

a resistor, wherein one end of the resistor is connected to the second branch of the gate of said PMOS transistor and the other end of the resistor is configured to connect to the ground signal;

a current source, wherein the current source is configured to connect to the fourth branch of the source of said PMOS transistor;

a low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

2. The input circuit according to claim 1, wherein the resistance of said resistor is greater or equal to 20G ohm.

3. A processing chip for a digital microphone comprising:

an input circuit, an amplifier circuit, and an analog-to-digital conversion circuit, wherein the input circuit comprises:

a PMOS transistor, wherein the gate of the PMOS transistor comprises a first branch and a second branch and said first branch being configured to receive the analog electronic signals outputted by the microphone, the source of said PMOS transistor includes a third branch and a fourth branch, and the drain of the PMOS transistor is configured to connect to a ground signal;

a resistor, wherein one end of the resistor is configured to connect to the second branch of the gate of said PMOS transistor and the other end of the resistor is configured to connect to the ground signal;

a current source, wherein the current source is configured to connect to the fourth branch of the source of said PMOS transistor;

a low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

4. The processing chip according to claim 3, wherein the resistance of said resistor is greater or equal to 20G ohm.

5. A digital microphone comprising: a microphone and a processing chip, wherein the processing chip comprises an input circuit, an amplifier circuit and an analog-to-digital conversion circuit, wherein the input circuit comprises:

a PMOS transistor, wherein the gate of the PMOS transistor comprises a first branch and a second branch and said first branch being configured to receive the analog electronic signals outputted by the microphone, the source of said PMOS transistor includes a third branch and a fourth branch, and the drain of the PMOS transistor is configured to connect to a ground signal;

a resistor, wherein one end of the resistor is configured to connect to the second branch of the gate of said PMOS transistor and the other end of the resistor is configured to connect to the ground signal;

a current source, wherein the current source is configured to connect to the fourth branch of the source of said PMOS transistor;

a low-pass filter, wherein one end of the low-pass filter is configured to connect to the third branch of the source of said PMOS transistor and the other end of the low-pass filter is configured to connect to an amplifier circuit;

wherein the source of the PMOS transistor further comprises a fifth branch connected with a metal layer underneath a pad of the first branch, wherein the area of the metal layer is larger than the area of the pad.

6. The digital microphone according to claim 5, wherein the resistance of said resistor is greater or equal to 20G ohm.

* * * * *